US009239028B2

(12) United States Patent
Mori et al.

(10) Patent No.: US 9,239,028 B2
(45) Date of Patent: Jan. 19, 2016

(54) CRANKCASE STRUCTURE OF INTERNAL COMBUSTION ENGINE

(71) Applicant: SUZUKI MOTOR CORPORATION, Hamamatsu-shi, Shizuoka (JP)

(72) Inventors: Koji Mori, Hamamatsu (JP); Shuichi Imanari, Hamamatsu (JP); Kohei Kato, Hamamatsu (JP); Makoto Nagao, Hamamatsu (JP)

(73) Assignee: SUZUKI MOTOR CORPORATION, Hamamatsu-Shi, Shizuoka (JP)

( * ) Notice: Subject to any disclaimer, the term of this patent is extended or adjusted under 35 U.S.C. 154(b) by 0 days.

(21) Appl. No.: 13/687,038

(22) Filed: Nov. 28, 2012

(65) Prior Publication Data

US 2013/0133612 A1 May 30, 2013

(30) Foreign Application Priority Data

Nov. 29, 2011 (JP) ..... 2011-260456

(51) Int. Cl.
*F02B 75/22* (2006.01)
*F02F 7/00* (2006.01)

(52) U.S. Cl.
CPC ..... *F02F 7/00* (2013.01); *F02F 7/0004* (2013.01); *F02F 7/0053* (2013.01); *F02F 7/0058* (2013.01); *F02F 2007/0041* (2013.01)

(58) Field of Classification Search
USPC ..... 123/195 R; 384/428–429, 432, 457, 384/462, 456, 535, 536, 250, 294, 434, 433
See application file for complete search history.

(56) References Cited

U.S. PATENT DOCUMENTS

| | | | | |
|---|---|---|---|---|
| 2,549,482 | A | 4/1951 | Kiehaefer | |
| 6,247,430 | B1 * | 6/2001 | Yapici | 123/78 F |
| 8,104,448 | B2 | 1/2012 | Kuribara et al. | |
| 2005/0205751 | A1 | 9/2005 | Utsumi et al. | |
| 2009/0241892 | A1 | 10/2009 | Kuribara et al. | |
| 2009/0241893 | A1 * | 10/2009 | Kuribara et al. | 123/195 R |

FOREIGN PATENT DOCUMENTS

| | | |
|---|---|---|
| CN | 101684854 | 3/2010 |
| JP | S63-48017 U | 4/1988 |
| JP | 2006-057605 A | 3/2006 |
| JP | 2009-079486 A | 4/2009 |
| JP | 2009243440 | 10/2009 |

OTHER PUBLICATIONS

European Search Report dated Jul. 25, 2014, which issued during prosecution of European Application No. 12193985.4, which corresponds to the present application.
Japanese Office Action dated Jul. 7, 2015, issued in corresponding Japanese Patent Application No. 2011-260456.

* cited by examiner

*Primary Examiner* — Hung Q Nguyen
*Assistant Examiner* — Ruben Picon-Feliciano
(74) *Attorney, Agent, or Firm* — Troutman Sanders LLP

(57) ABSTRACT

A bearing holding portion supporting a crankshaft in a manner to rotate freely via a bearing and fittingly holding the bearing is formed in a crankcase. A second cross section passing through a crankshaft axis line and along an orthogonal direction to a cylinder axis line is set to have a larger cross-sectional area than a first cross section passing through the crankshaft axis line and along a direction of the cylinder axis line in the bearing holding portion.

5 Claims, 11 Drawing Sheets

CRANKCASE STRUCTURE OF INTERNAL COMBUSTION ENGINE

CROSS-REFERENCE TO RELATED APPLICATIONS

This application is based upon and claims the benefit of priority of the prior Japanese Patent Application No. 2011-260456, filed on Nov. 29, 2011, the entire contents of which are incorporated herein by reference.

BACKGROUND OF THE INVENTION

1. Field of the Invention

The present invention relates to a crankcase structure of an engine mounted on a vehicle such as a motorcycle.

2. Description of the Related Art

In an internal combustion engine such as a gasoline engine, explosion energy generated in an upper part of a piston is transmitted to a crankshaft via a connecting rod, and thereby the crankshaft is rotated. The crankshaft is supported by a crankcase via a bearing, and quite a large load due to engine explosion acts not only on the bearing but also on a bearing supporting portion of the crankcase. Since the crankshaft rotates at a high speed while receiving such a large load, high rigid strength is required of a shaft receiving bearing which supports the crankshaft and a vicinity of the bearing supporting portion.

Here, the above will be explained by using a concrete example of an engine of this kind. For example, in a four-cycle single-cylinder engine 10 shown in FIG. 8 and FIG. 9, a crankcase 11 housing and supporting a crankshaft 12 in a rotatable manner, a cylinder 15 housing, in a vertically movable manner, a piston 14 coupled to the crankshaft 12 via a connecting rod 13, a cylinder head 17 housing a valve driving device 16, and a cylinder head cover 18 attached to cover the cylinder head 17 are connected in series in an approximately vertical direction.

As shown in FIG. 9, an intake port 19 and an exhaust port 20 which are each communicated with a combustion chamber 21 are formed in the cylinder head 17. The intake port 19 and the exhaust port 20 are opened and closed at a predetermined timing by an intake valve 22 and an exhaust valve 23 driven by the valve driving device 16.

In this example, as shown in FIG. 8, the crankcase 11 is configured to be right-and-left two-split along a split surface S. In this case, as shown in FIG. 10, a crank chamber 24 is formed by a right side crankcase 11R and a left side crankcase 11L, and in the crank chamber 24 a crankshaft 12 and a right and left pair of crank webs 12A which rotates integrally with the crankshaft 12 are axially supported in a manner to rotate freely. The connection rod 13 is coupled between each crank webs 12A, via a crank pin 25. Note that in a surrounding of the crank chamber 24, a mission chamber 26 is disposed in a rear side behind a case partition, a clutch chamber 27 is disposed in a right side thereof, and a magneto chamber 28 is disposed in a left side, adjacently to each other.

The crankshaft 12 is supported by a pair of bearings 29. In this example, as the bearing 29, a ball roller bearing is used, but a cylindrical roller bearing or a metal slide bearing can be used. The respective bearings 29 are fit into bearing holding portions 30 provided in the right side crankcase 11R and the left side crankcase 11L respectively and are fixedly supported inside the bearing holding portions 30. The bearing holding portion 30 has a cross section of an approximately band shape as indicated by a dashed line in FIG. 10, in order to equalize a fastening margin to the bearing 29, that is, a press-fit margin or a deformation margin.

At a time of engine explosion, as shown in FIG. 9, its explosion pressure P is received by a piston 14, and transmitted from the piston 14 to the crankshaft 12 via the connecting rod 13. The crankshaft 12 rotationally moves, and its explosive force simultaneously acts from the crankshaft 12 to the bearing holding portion 30 as a load $F_1$ as indicated in FIG. 11. The explosive pressure P also acts on a cylinder head 17 side. Here, as shown in FIG. 8, the cylinder head 17 is fastened to the crankcase 11 by cylinder head bolts 31. In this case, the cylinder head bolts 31 are screwed to female screws 33 formed in a boss portion 32 provided in the crankcase 11. The explosive pressure P acting on the cylinder head 17 side acts on the crankcase 11 via the cylinder head bolt 31 as a load $F_2$.

Patent Document 1: Japanese Laid-open Patent Publication No. 2009-243440

Action of the load $F_1$ and the load $F_2$ as above at the time of engine explosion causes occurrence of a stress-strain $E_1$ in a cylinder axis line direction and a stress-strain $E_2$ in an orthogonal direction to the cylinder axis line in the cylinder case 11, if no measure is taken. In order to suppress occurrence of a crack or a deformation of the crankcase 11 due to the stress-strains $E_1$, $E_2$, ribs 34 are provided between the bearing holding portion 30 and the boss portions 32. Though rigidity can be strengthened by providing the ribs 34, it is not always sufficient. That is, for the bearing holding portion 30 and the ribs 34, it is difficult to completely suppress a deformation responding to the stress-strains $E_1$, $E_2$ as indicated by two-dot chain lines of FIG. 11.

Note that Patent Document 1 discloses an example of a rib of this kind.

SUMMARY OF THE INVENTION

In view of the above-described circumstances, an object of the present invention is to provide a crankcase structure of an internal combustion engine which realizes rigidity strengthening of a crankcase effectively while practically suppressing weight increase.

A crankcase structure of an internal combustion engine of the present invention has a bearing holding portion formed in a crankcase, the bearing holding portion supporting a crankshaft in a manner to rotate freely via a bearing and fittingly holding the bearing, wherein a second cross section passing through a crankshaft axis line and along an orthogonal direction to a cylinder axis line is set to have a larger cross-sectional area than a first cross section passing through the crankshaft axis line and along a direction of the cylinder axis line in the bearing holding portion.

Further, in the crankcase structure of the internal combustion engine of the present invention, a length along the orthogonal direction to the cylinder axis line of the second cross section is set larger than a length along the direction of the cylinder axis line of the first cross section.

Further, in the crankcase structure of the internal combustion engine of the present invention, a pair of the bearing holding portions is separately disposed in a direction of the crankshaft axis line across the cylinder axis line, and a cross-sectional area of the second cross section in at least either one of the bearing holding portions is set larger than that of the first cross section.

Further, the crankcase structure of the internal combustion engine of the present invention has: a plurality of boss portions to which cylinder head bolts are screwed; and a first rib formed to connect the boss portion and the bearing holding portion, wherein a mutual interval of the first ribs is wider than the bearing holding portion.

The crankcase structure of the internal combustion engine of the present invention has a second rib formed to connect each vicinity of lower end parts of the boss portions.

Further, in the crankcase structure of the internal combustion engine of the preset invention, the crankcase is configured to be right and left two-split in relation to the cylinder axis line, and each split portion has the bearing holding portion.

DETAILED DESCRIPTION OF THE PREFERRED EMBODIMENTS

Hereinafter, a preferred embodiment of a crankcase structure of an internal combustion engine according to the present invention will be described based on the drawings.

Figure 1:
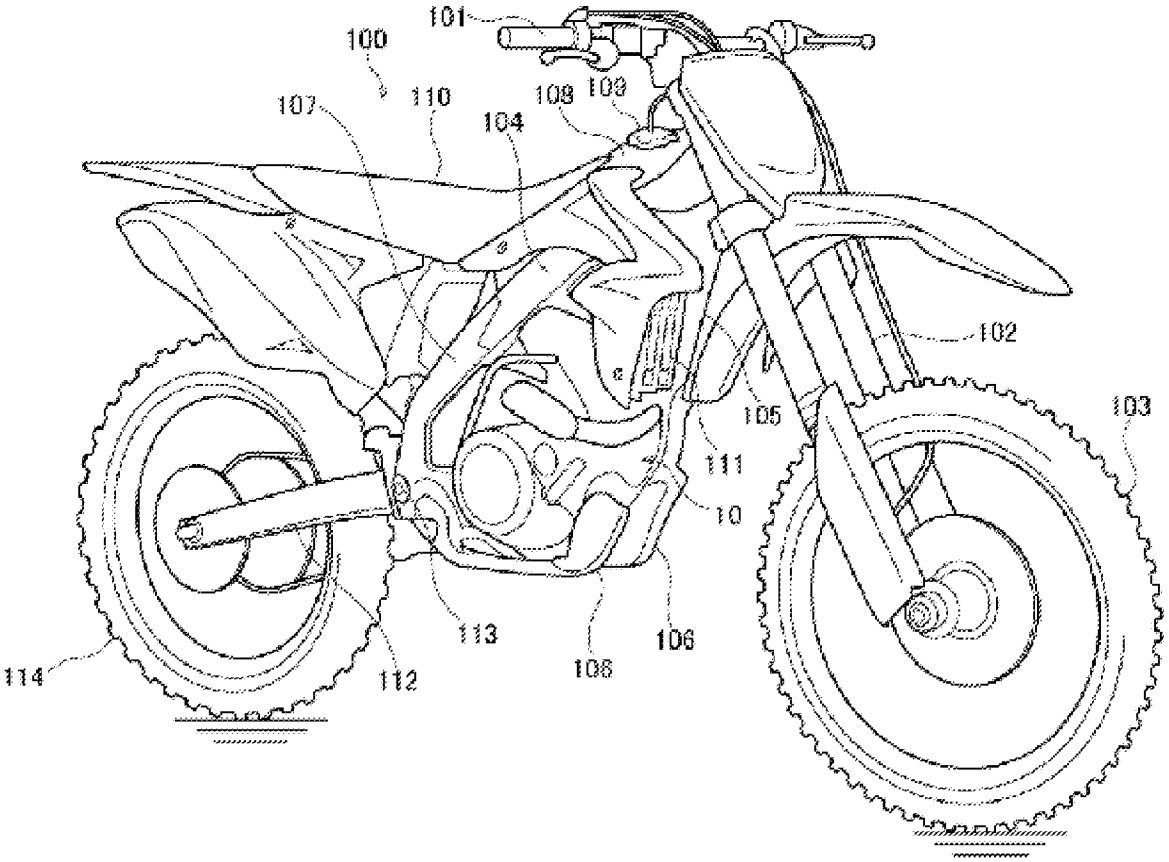
FIG. 1 is a front perspective view showing an entire configuration of a motorcycle according to the present invention.

FIG. 1 is a front perspective view of a motorcycle according to the present embodiment. First, an entire configuration of a motorcycle 100 will be described by using FIG. 1. Note that in the following explanation, in each drawing including FIG. 1, as necessary, the front of a vehicle is indicated by an arrow Fr and the rear of the vehicle is indicated by an arrow Rr, respectively, and that a lateral right side of the vehicle is indicated by an arrow R, and a lateral left side of the vehicle is indicated by an arrow L, respectively.

The motorcycle 100 of FIG. 1 can typically be what is called an off-road motorcycle, and a steering head pipe, not shown, is disposed in a front upper part of its vehicle body, and a steering shaft is pivotably inserted in the steering head pipe. A handle 101 is bound to an upper end of the steering shaft, a front fork 102 is mounted on a lower end of the steering shaft, and a front wheel 103 being a steering wheel is axially supported in a rotatable manner by a lower end of the front fork 102.

Further, from the steering head pipe, a right and left pair of main frames 104 extends inclining diagonally downward toward the rear of the vehicle body, and a down tube 105 extends almost vertically downward. The down tube 105 branches to right and left as lower frames 106 around a lower part of the down tube 105, and a pair of the lower frames 106 extends downward, and thereafter is bent almost at a right angle toward the rear of the vehicle body, rear end portions thereof being coupled to respective rear end portions of the main frame 104 via a right and left pair of body frames 107.

In a space surrounded by the right and left pair of main frames 104 and the down tube 105, and the lower frames 106 and the body frames 107, a water-cooled engine 10 being a driving source is mounted. A fuel tank 108 is disposed above the engine 10, and a fuel supply port of the fuel tank 108 is plugged by a cap 109. A seat 110 is disposed behind the fuel tank 108. Further, a radiator 111 is disposed in front of the engine 10.

In the right and left pair of body frames 107 provided in a lower part of an approximate center in a front and rear direction of the vehicle body, a front end portion of a rear swing arm 112 is held in a vertically swingable manner by a pivot shaft 113. A rear wheel 114 being a driving wheel is axially supported in a rotatable manner by a rear end portion of the rear swing arm 112. Note that, though not shown, the rear swing arm 112 is suspended from the vehicle body via a link mechanism and a shock absorber (rear wheel suspension system) coupled thereto.

Further, a fuel pump unit is disposed inside the fuel tank 108, and fuel is supplied to the engine 10 by the fuel pump unit. On the other hand, an air cleaner box is disposed in a rear side of the aforementioned shock absorber, and the air cleaner box and the engine 10 are coupled via an intake path. The intake path is connected to an intake port provided in a cylinder head of the engine 10, and on the way thereto, a throttle body is disposed as a part of the intake path. A fuel injector is provided in the throttle body, and it is constituted that fuel of a predetermined pressure is supplied to the fuel injector from the fuel pump unit.

Figure 8:
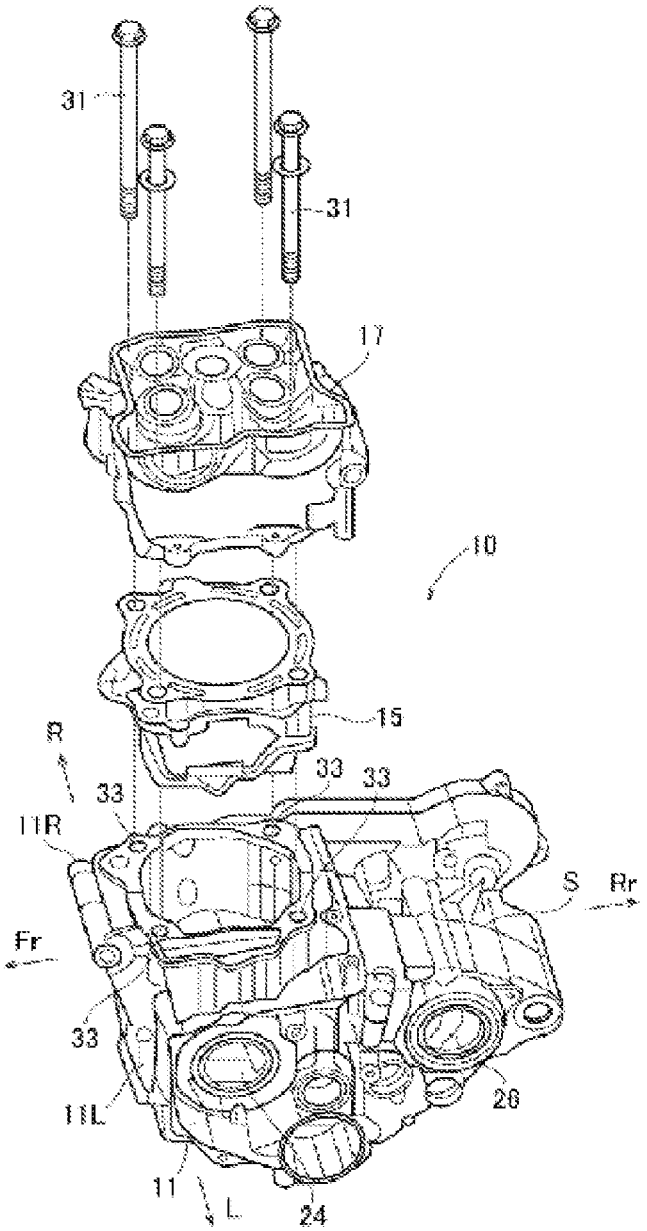
FIG. 8 Prior Art
FIG. 8 is an exploded perspective view of an engine according to a conventional crankcase structure.
Figure 9:
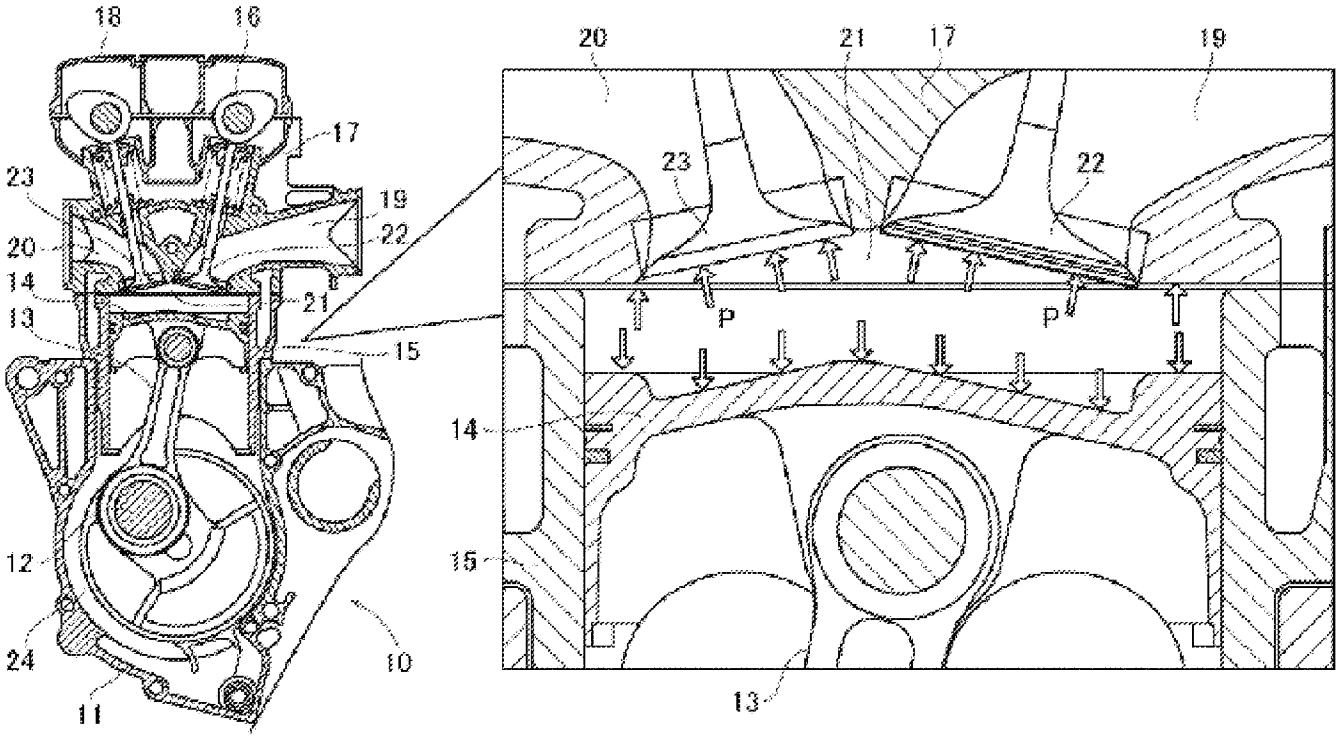
FIG. 9 Prior Art
FIG. 9 is a longitudinal cross-sectional view and a partially enlarged view of the engine according to the conventional crankcase structure.
Figure 10:
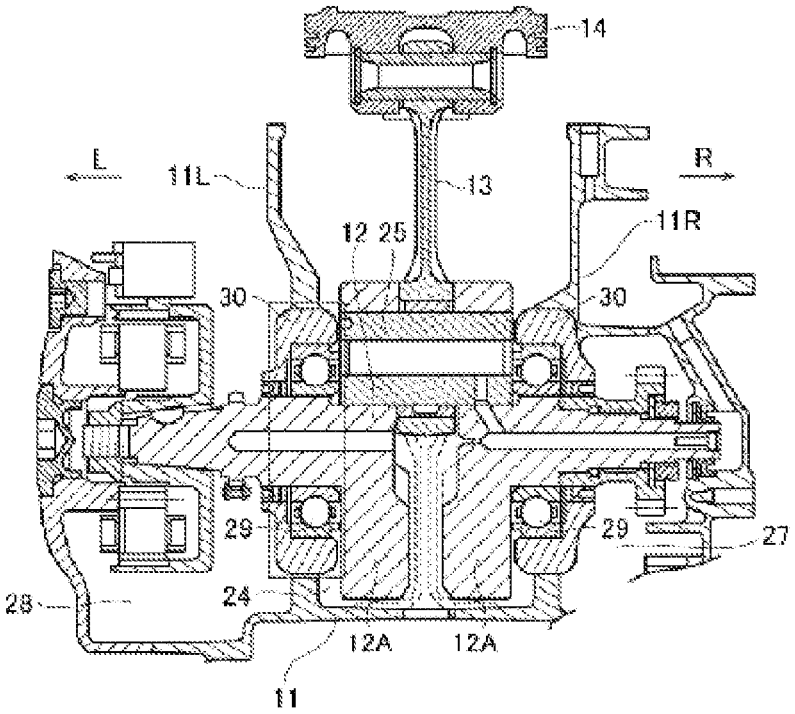
FIG. 10 Prior Art
FIG. 10 is a longitudinal cross-sectional view along a cylinder axis line direction in the engine according to the conventional crankcase structure.
Figure 11:
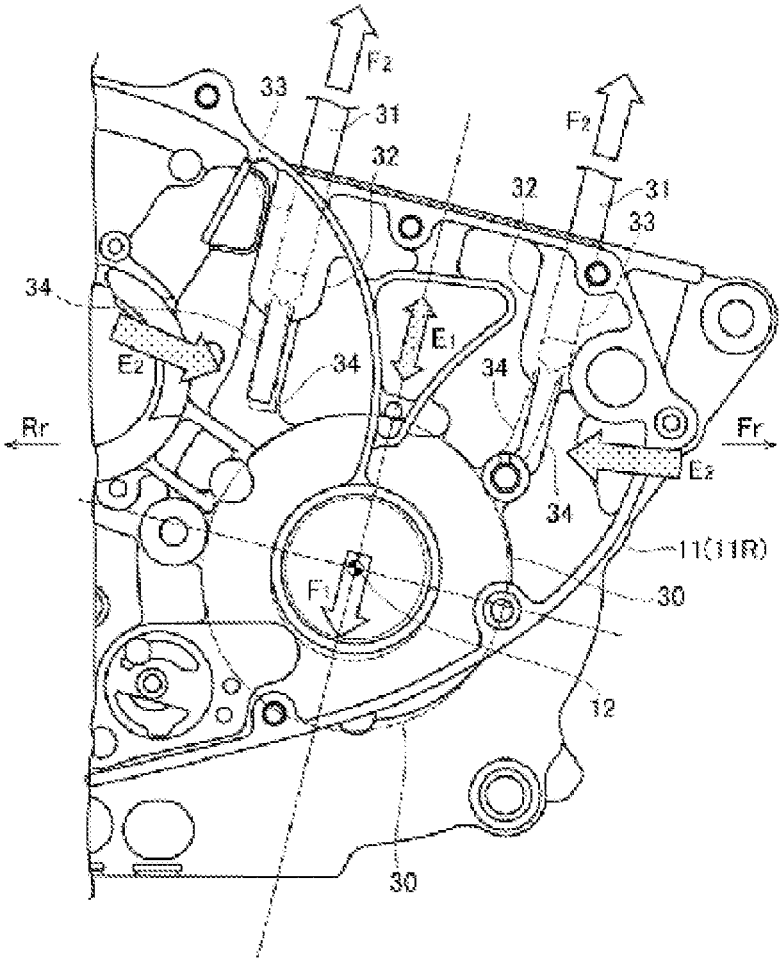
FIG. 11 Prior Art
FIG. 11 is a partial side view showing a vicinity of a bearing holding portion in the conventional crankcase.

Next, a configuration of the engine 10 will be described. Here, in this example, a basic configuration of the engine 10 is similar to that depicted in FIG. 8 to FIG. 10 already explained as a conventional example, a member practically the same as or corresponding to that in the conventional example is given the same reference numeral, and FIG. 8 to FIG. 10 are referred to as necessary in the following explanation. Also in the present embodiment, the engine 10 has a crankcase 11 housing and supporting a crankshaft 12 in a rotatable manner, a cylinder 15 housing a piston 14 in a vertically movable manner, a cylinder head 17 housing a valve driving device 16, and a cylinder head cover 18 attached to cover the cylinder head, and these components are connected in series in an approximately vertical direction.

Figure 2:
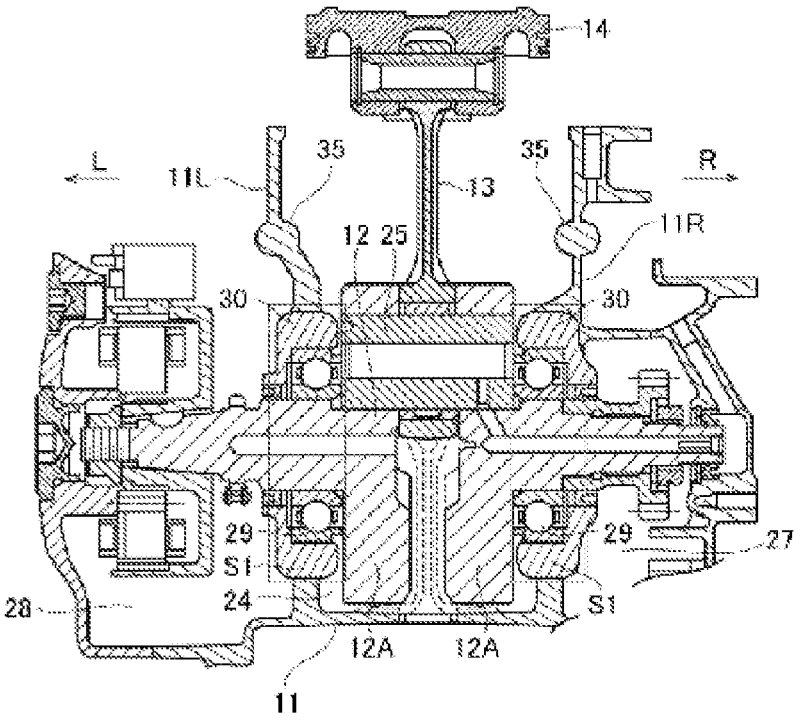
FIG. 2 is a longitudinal cross-sectional view along a cylinder axis line direction in an engine according to an embodiment of the present invention.

FIG. 2 shows a longitudinal cross-sectional view through a crankshaft axis line and along a cylinder axis line direction. Also in this example, as shown in FIG. 2, the crankcase 11 is configured to be right and left two split. A crank chamber 24 is formed by a right side crankcase 11R and a left side crankcase 11L, and inside the crank chamber 24 a crankshaft 12 and a right and left pair of crank webs 12A which rotates integrally with the crankshaft 12 are axially supported in a manner to rotate freely. A connection rod 13 is coupled between respective crank webs 12A, via a crank pin 25. Note that, in a surrounding of the crank chamber 24, there are disposed adjacently to each other a mission chamber 26 in a rear side across a case partition, a clutch chamber 27 in a right side thereof, and a magneto chamber 28.

The crankshaft 12 is supported by a pair of bearings 29. In this indicated example, as the bearing 29, a ball roller bearing is used, but a cylindrical roller bearing or a metal slide bearing can be used. The respective bearings 29 are press-fit into bearing holding portions 30 provided in side walls of the right side crankcase 11R and the left side crankcase 11L respectively, and are fixedly supported inside the bearing holding portions 30. The bearing holding portions 30 isolatedly disposed in a direction of a crankshaft axis line across a cylinder axis line Z (see FIG. 3) have cross sections of approximate band shapes as indicated by dashed lines in FIG. 2. The basic configuration above is practically similar to that in the conventional example.

Figure 3:
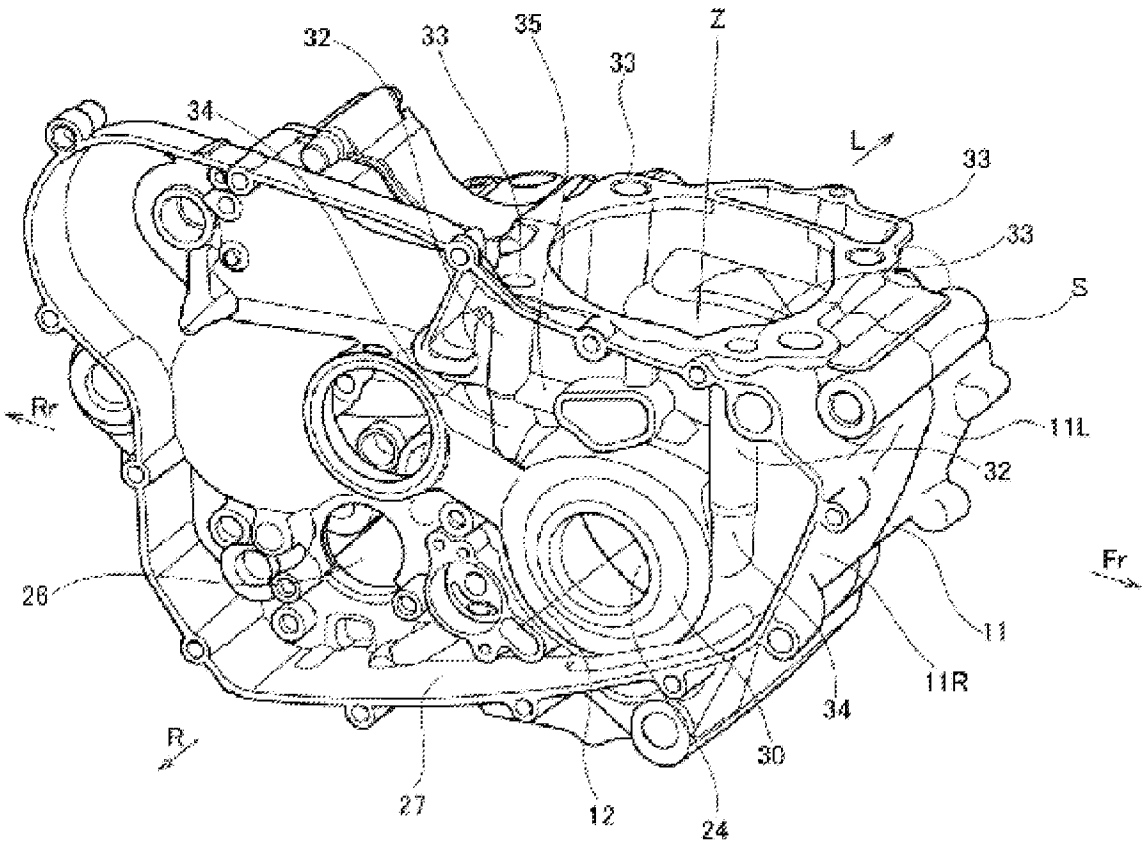
FIG. 3 is a perspective view showing a crankcase of the engine according to the embodiment of the present invention.
Figure 4:
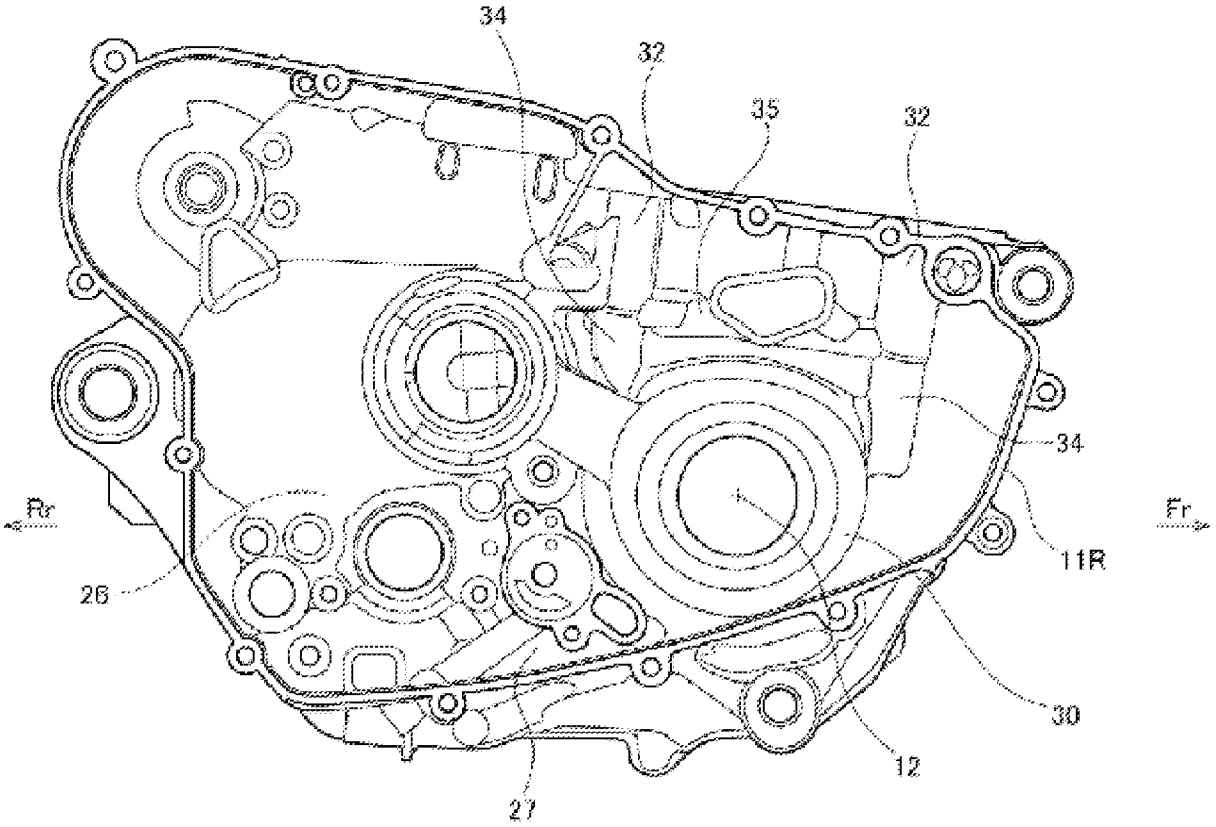
FIG. 4 is a side view showing a right side crankcase of the engine according to the embodiment of the present invention.
Figure 5:
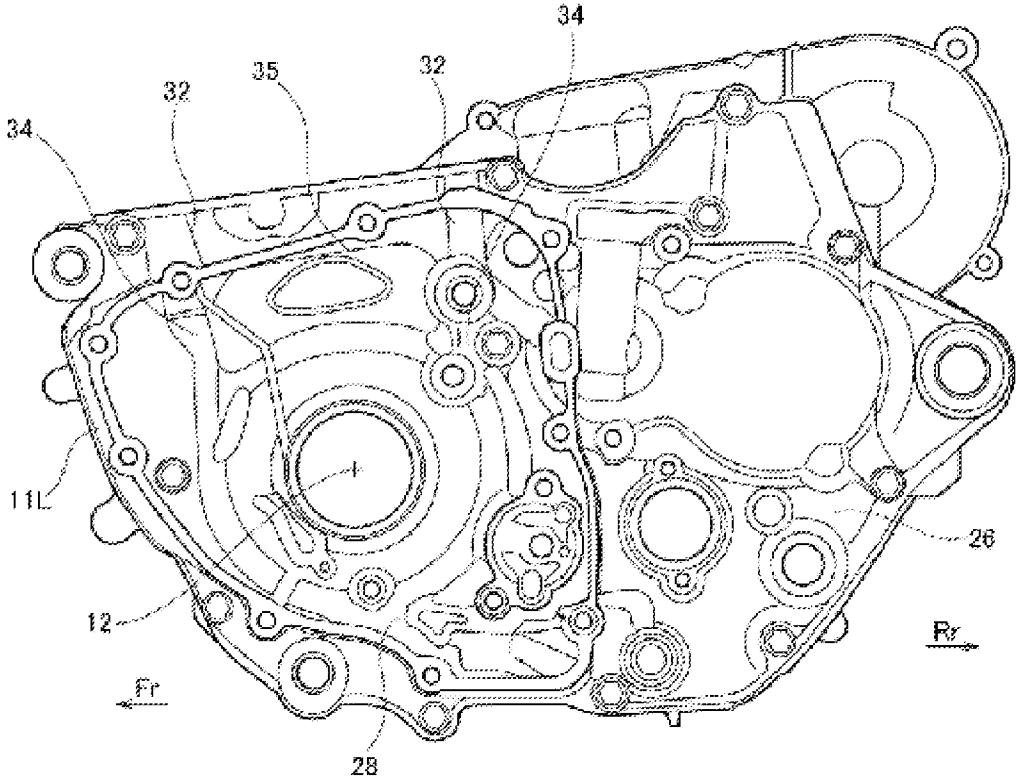
FIG. 5 is a side view showing a left side crankcase of the engine according to the embodiment of the present invention.

FIG. 3 shows the crankcase 11 of the engine 10 in the present embodiment, and the crankcase 11 is configured to be right and left two-split along a split surface S with the right side crankcase 11R and the left side crankcase 11L. Note that FIG. 4 is a view of the right side crankcase 11R seen from a right outer side and that FIG. 5 is a view of the left side crankcase 11L seen from a left outer side. Here, the right side crankcase 11R will be mainly explained, but the left side crankcase 11L is practically similar. There is had a plurality of female screws 33 to which cylinder head bolts 31 for fastening a cylinder head 17 to the crankcase 11 are screwed, that is, in this case, four female screws 33 at diagonal positions of a periphery to surround the cylinder 13 in relation to the cylinder axis line Z. Each respective female screw 33 is formed in a boss portion 32 extendedly provided downward along the cylinder axis line Z direction, that is, to a crankcase 11 side. Further, a rib 34 (first rib) is provided between the bearing holding portion 30 and the boss portion 32.

Figure 6:
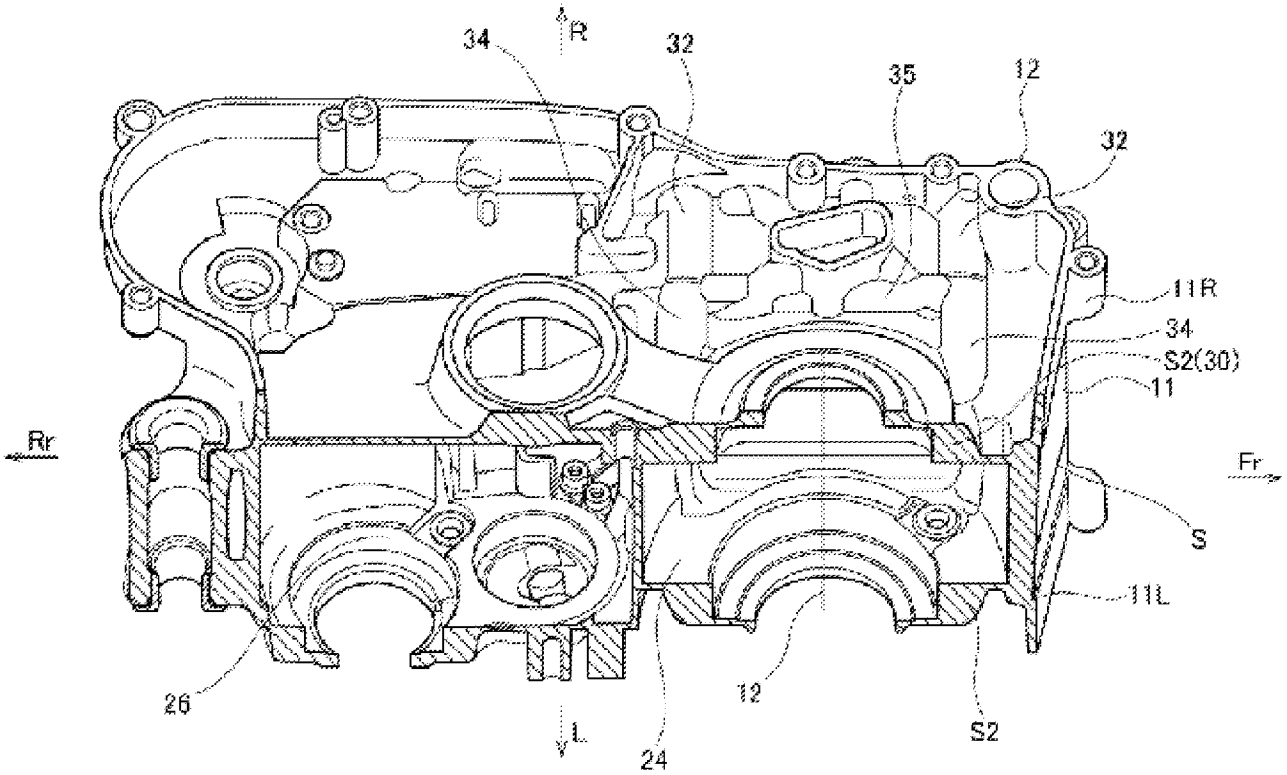
FIG. 6 is a partially cutaway perspective view showing the crankcase of the engine according to the embodiment of the present invention.

The bearing holding portion 30 is formed to be approximately ring-shaped ranging over the entire outer periphery of the bearing 29, in a manner to surround a periphery of the bearing 29. Here, in the present invention, a cross-sectional area passing through a crankshaft axis line of the bearing holding portion 30 in particular is not constant along the ring-shape, but changes according to a predetermined relation. In other words, as shown in FIG. 2 a cross section passing through the crankshaft axis line and along the cylinder axis line Z in the bearing holding portion 30 is defined as a first cross section $S_1$, and as shown in FIG. 6 a cross section passing through the crankshaft axis line and along an orthogonal direction to the cylinder axis line Z is defined as a second cross section $S_2$. Then, the second cross section $S_2$ is set larger than the first cross section $S_1$.

Figure 7:
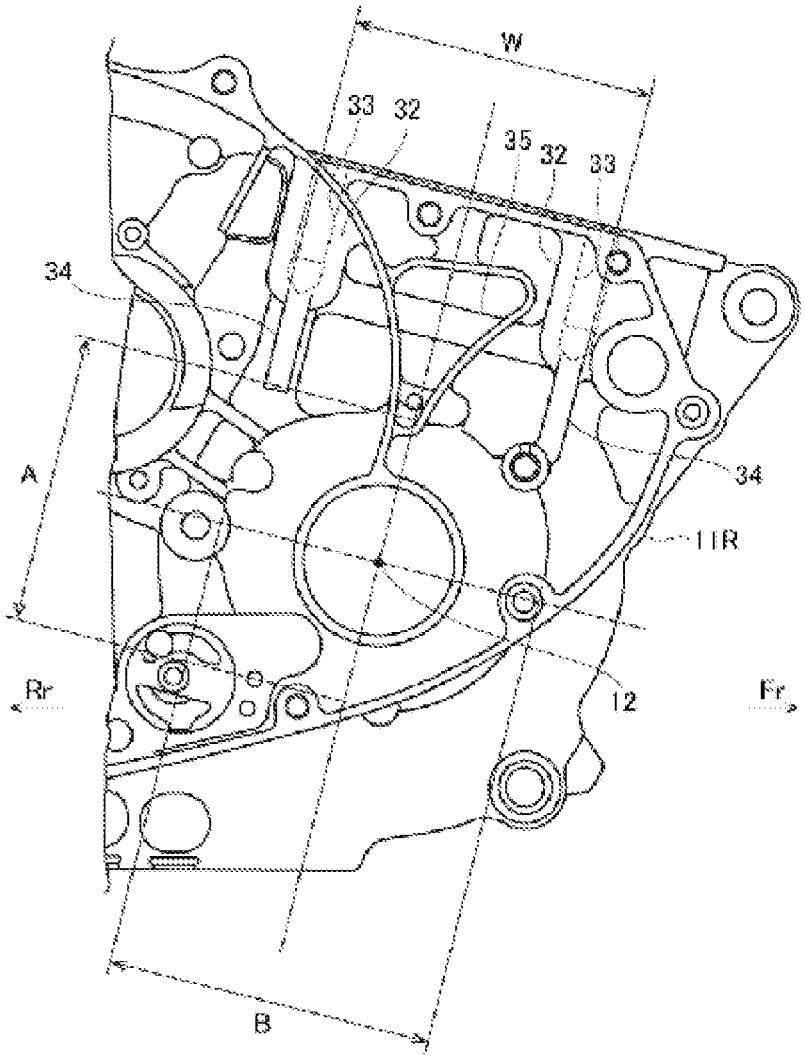
FIG. 7 is a partial side view showing a vicinity of a bearing holding portion in the crankcase of the engine according to the embodiment of the present invention.

In order for change of the cross-sectional area described above, in this example, a length B along the orthogonal direction to the cylinder axis line Z in the second cross section $S_2$ is set longer than a length A along a direction of the cylinder axis line Z in the first cross section $S_1$, as shown in FIG. 7. As a result that the length B of the second cross section $S_2$ is set longer than the length A of the first cross section $S_1$, the ring shape of the holding portion 30 surrounding the bearing 29 is not round but is a shape which is appropriately crushed in the cylinder axis line Z direction, when seen as a whole. In this case, the length A in the cylinder axis line Z direction is practically compliant with a size of a usual crankcase, and the length B in the orthogonal direction to the cylinder axis line Z is set longer than usual. Note that such a shape of the bearing holding portion 30 is illustrated in a case of the right side crankcase 11R in FIG. 7 and that the shape in the left side crankcase 11L is practically similar.

As a result that the second cross section $S_2$ in the orthogonal direction to the cylinder axis line Z in the bearing holding portion 30 is increased as describe above, a deformation or the like of the bearing holding portion 30 due to a load acting at a time of engine explosion can be suppressed effectively. In this case, since the length A along the cylinder axis line Z direction of the bearing holding portion 30 is not made practically longer, and does not become a cause for the deformation due to the load at the time of engine explosion even without being made longer, so that rigidity can be strengthened while weight increase as the bearing holding portion 30 as a whole is suppressed as much as possible. On the other hand, with regard to a pressure fitting margin of the bearing 29, when warm-up is sufficiently done after start of the engine, the crankcase 11 made of an aluminum alloy thermal-expands more than the bearing 29, so that the pressure fitting margin is hardly left, and thus there is no problem even if the bearing holding portion 30 is not even.

Further, the boss portion 32 and the bearing holing portion 30 are connected by the rib 34, and as shown in FIG. 7, a mutual interval W between the ribs 34 is wider than the bearing holding portion 30.

First, the boss portions 32 directly above the bearings 29 are pulled by the load acting at the time of engine explosion, and the boss portions 32 are deformed toward inside each other if nothing is done, but by extending the ribs 34 with comparatively large diameters from lower ends of the boss portions 32, such a deformation can be prevented effectively. Thereby, it is possible to suppress occurrence of a crack or a deformation in the crankcase 11. Further, as a result that the mutual interval W between the ribs 34 is set wider than the length B of the bearing holding portion 30, direct action of the load on the bearing holding portion 30 can be suppressed, enabling prevention of the deformation of the bearing holding portion 30 and its vicinity, also in that point.

Further, as shown in FIG. 2 to FIG. 4 or in FIG. 7 and so on, there is had a rib 35 (second rib) formed to connect each vicinity of lower end parts of the boss portions 32.

By providing the rib 35, it is possible to more surely prevent the boss portions 32 from being deformed in a manner to approach each other by the load acting at the time of engine explosion, and the ribs 34 from being deformed toward inside in correspondence therewith.

Hereinabove, though the present invention is described with various embodiments, the present invention is not limited only to those embodiments, but alteration and the like are possible within a scope of the present invention.

For example, a cross-sectional shape of the rib 35 connecting each vicinity of the lower end portions of the boss portions 32 can be circular as shown in FIG. 2, and can, as well, be other shaped such as approximately rectangular. Further, the rib 35 is not necessarily required to have an even cross section, and two or more ribs 35 can be provided.

Further, explained is a case of application to the respective bearing holding portions 30 of the right side crankcase 11R and the left side crankcase 11L, but application to either one can effectively function to prevent a deformation of the crankcase 11.

Further, explained is a case where the crankcase 11 is right and left two-split, but the present invention is applicable to a case of a crankcase of upper-and-lower split in relation to a crankshaft axis line.

According to the present invention, as a result that a cross section passing through a crankshaft axis line and along an orthogonal direction to a cylinder axis line is set larger than a cross section along a direction the cylinder axis line in a bearing holding portion, rigidity can be strengthened while weight increase as the bearing holding portion as a whole is suppressed as much as possible. Thereby, it is possible to effectively suppress a deformation or the like of the bearing holding portion and its vicinity due to a load acting at a time of engine explosion.

It should be noted that the above embodiments merely illustrate concrete examples of implementing the present invention, and the technical scope of the present invention is not to be construed in a restrictive manner by these embodiments. That is, the present invention may be implemented in various forms without departing from the technical spirit or main features thereof.

What is claimed is:

1. A crankcase structure of an internal combustion engine, the crankcase structure comprising:

a bearing holding portion formed in a crankcase, the bearing holding portion supporting a crankshaft in a manner to rotate freely via a bearing and fittingly holding the bearing, wherein the bearing holding portion is formed integrally with the crankcase and continuously formed in a crushed round shape along a whole outer periphery of the bearing so as to surround the bearing, wherein a second cross section passing through a crankshaft axis line and along an orthogonal direction to a cylinder axis line is set to have a larger cross-sectional area than a cross-sectional area of a first cross section passing through the crankshaft axis line and along a direction of the cylinder axis line in said bearing holding portion, wherein a length along the orthogonal direction to the cylinder axis line of the second cross section is set larger than a length along the direction of the cylinder axis line of the first cross section, and wherein cross sections located on one side and another other side across the crankshaft axis line in the second cross section are each set larger in cross-sectional area than either larger one of cross sections located on one side and another side across the crankshaft axis line in the first cross section.

2. The crankcase structure of the internal combustion engine according to claim 1, wherein a pair of said bearing holding portions is separately disposed in a direction of the crankshaft axis line across the cylinder axis line, and wherein a cross-sectional area of the second cross section in at least either one of said bearing holding portions is set larger than that of the first cross section.

3. The crankcase structure of the internal combustion engine according to claim 1, comprising:

a plurality of boss portions to which cylinder head bolts are screwed; and a first rib formed to connect said boss portion and said bearing holding portion, wherein a mutual interval of said first ribs is wider than said bearing holding portion.

4. The crankcase structure of the internal combustion engine according to claim 3, comprising:

a second rib formed to connect each vicinity of lower end parts of said boss portions.

5. The crankcase structure of the internal combustion engine according to claim 1, wherein the crankcase is configured to be right and left two-split in relation to the cylinder axis line, each split portion having said bearing holding portion, and the bearing holding portions are each formed integrally with the crankcase and continuously formed in a crushed round shape along a whole outer periphery of the bearing so as to surround the bearing.

* * * * *